US006050241A

United States Patent [19]

Reiling

[11] Patent Number: 6,050,241

[45] Date of Patent: Apr. 18, 2000

[54] CONTROL DEVICE FOR CONTROLLING AN OUTPUT OF A DRIVING MACHINE

[75] Inventor: Eckard Reiling, Eisingen, Germany

[73] Assignee: Robert Bosch GmbH, Stuttgart, Germany

[21] Appl. No.: 08/973,947

[22] PCT Filed: Nov. 21, 1996

[86] PCT No.: PCT/DE96/02220

§ 371 Date: Apr. 15, 1998

§ 102(e) Date: Apr. 15, 1998

[87] PCT Pub. No.: WO97/37116

PCT Pub. Date: Oct. 9, 1997

[30] Foreign Application Priority Data

Mar. 30, 1996 [DE] Germany ..... 196 12 869

[51] Int. Cl.[7] ..... F02D 9/10

[52] U.S. Cl. ..... 123/396; 123/399

[58] Field of Search ..... 123/396, 398, 123/399

[56] References Cited

U.S. PATENT DOCUMENTS

| | | | |
|---|---|---|---|
| 5,141,070 | 8/1992 | Hickmann et al. | 123/396 |
| 5,172,667 | 12/1992 | Spiegel | 123/396 |
| 5,297,521 | 3/1994 | Sasaki et al. | 123/396 |
| 5,492,097 | 2/1996 | Byram et al. | 123/396 |
| 5,775,292 | 7/1998 | Seeger | 123/396 |
| 5,812,050 | 9/1998 | Figgins | 123/396 |

*Primary Examiner*—Erick R. Solis

*Attorney, Agent, or Firm*—Ronald E. Greigg; Edwin E. Greigg

[57] ABSTRACT

A control device in which if the control device fails the throttle valve reaches an emergency operation position by use of only one spring. If the control device fails, the single spring can move a throttle valve to an emergency operation position, located between two terminal positions. This is achieved by various-sized speed-changing gears between the two spring connections and an intermediate member. No additional spring is needed for this. The control device is suitable particularly for vehicles that have a throttle-type internal combustion engine.

20 Claims, 8 Drawing Sheets

CONTROL DEVICE FOR CONTROLLING AN OUTPUT OF A DRIVING MACHINE

PRIOR ART

The invention is based on a control device for controlling an output of a driving machine.

In a known control device (International Patent Application WO 88/02064), there is a control element for controlling the output of a driving machine. The control element takes the form of a throttle valve. The control element can be adjusted with the aid of a control device. If the control device should fail or is turned off, the control element is in a position of repose. The position of repose is dimensioned such that emergency operation of the driving machine is possible.

In the known control device, there is a restoring spring, which urges the control element in the direction of closure of the intake conduit. A second spring acting as an emergency operation spring urges the control element in the opening direction, until the control element reaches the position of repose. By means of a stop on which the second spring can come to rest, it is attained that the second spring can urge the control element only as far as the position of repose.

The known control device has the disadvantage of requiring one additional, powerful spring, which is disadvantageous in terms of the production cost and the structural size of the known control device.

ADVANTAGES OF THE INVENTION

The control device according to the invention for controlling an output of a driving machine has the advantage that the spring assembly can adjust the control element both from the direction of the first terminal position and from the direction of the second terminal position into the position of repose located between the two terminal positions. This reduces the number of springs required, thus advantageously markedly reducing the production cost and the structural space required.

By the provisions recited hereinafter advantageous further refinements of and improvements to the control device are possible.

If the control element and the intermediate member are supported rotatably or pivotably, and if the actions of the spring assembly occur in the form of torques, then advantageously by simple adaptation of the radii, the actions of the spring assembly can be adapted very simply.

If the speed-changing gear includes a transmission stage between the control element and the intermediate member or intermediate wheel, and this transmission stage increases the rpm of the control element in the direction of the intermediate member or intermediate wheel, then advantageously this transmission stage can also be jointly used as part of the change of the rpm of the control device to the angular speed of the control element.

If the second pivotable spring connection, or the suitably shaped end of the spring assembly that forms the second pivotable spring connection, comes to rest on the repose stop in the position of repose, then the number of components required is advantageously reduced still further.

If the repose stop is defined such that when the repose stop determines the position of the control element, the control element is in a position in which the driving machine is in emergency operation, this has the advantage that even if the control device should fail, emergency operation of the driving machine is possible. Nor can the throttle valve become firmly stuck in the gas conduit even if the driving machine has been turned off for a relatively long time.

If the control device is connected to the control element via the intermediate member, this has the advantage that to reduce the rpm of the control device to the control element, the transmission stage between the intermediate member and the control element can be jointly used.

If the joined spring assembly is used for axially tensing the throttle valve shaft, this has the advantage that the number of components required is additionally reduced markedly.

BRIEF DESCRIPTION OF THE DRAWINGS

Selected, especially advantageous exemplary embodiments of the invention are shown in simplified form in the drawing and described in further detail in the description below.

DESCRIPTION OF THE EXEMPLARY EMBODIMENTS

The control device of the invention can be used in any driving machine in which the output of the driving machine is to be controlled. The driving machine may either be erected in stationary fashion, or by way of example it may be a self-propelled machine, in other words a vehicle. For instance, the driving machine is an Otto engine with an intake conduit. In that case, the control element takes the form of a throttle valve, for instance. The driving machine may also be a Diesel engine, and in that case the control element may be an adjusting lever for adjusting the injection quantity of the injection pump. The driving machine may also be an electric motor. Then the control element is a lever, for instance, with which the current to the electric motor can be varied.

Although not limited solely to this, for the sake of simplicity it will be assumed in the ensuing description of the exemplary embodiments that the control device of the invention is installed in a vehicle with an Otto engine.

Figure 1:
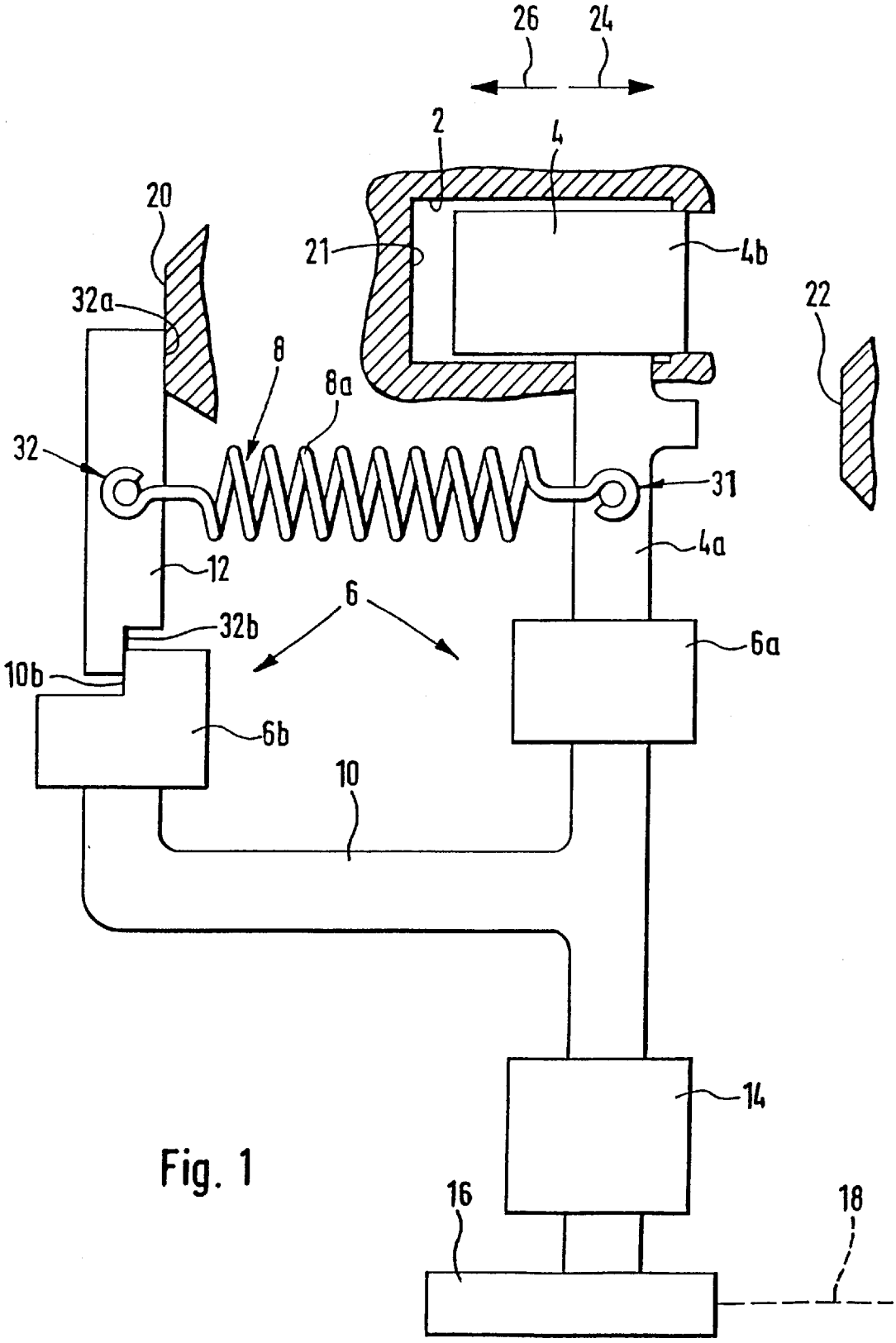
FIGS. 1, 2, 3 and 6 symbolically show various exemplary embodiments.

FIG. 1 symbolically shows a first particularly selected exemplary embodiment.

FIG. 1 shows a gas conduit 2, a control element 4, an adjusting lever 4*a*, a speed-changing gear 6 of a transmission, a spring assembly 8 with a spring 8*a*, an intermediate member 10, a stop piece 12, a speed-changing gear 14, a control device 16, an electric line 18, a repose stop 20, a first terminal position stop 21, and a second terminal position stop 22.

The gas conduit 2 leads for example from an air filter, not shown, to combustion chambers of the driving machine, not shown. Air or fuel-air mixture, for instance, flows through the gas conduit. In the exemplary embodiment shown in FIG. 1, the control element 4 takes the form of a slide 4*b*. With the slide 4*b*, the free cross section of the gas conduit 2 can be opened to a variable extent.

In the drawing, an arrow 24 and an arrow 26 pointing in the opposite direction are shown. In the preferably selected exemplary embodiment, an adjustment of the control element 4 in the direction of the arrow 24 represents an increase in the free cross section through the gas conduit 2, and hence an increase in the output demanded by the driving machine. An adjustment in the direction of the arrow 26 represents a decrease in the output of the driving machine.

The control device 16 is an electric motor, for instance, preferably a high-speed dc motor. The control device 16 can adjust the intermediate member 10 and the control element 4 with the adjusting lever 4*a* and the slide 4*b* in the direction of the arrow 24, until the adjusting lever 4*a* comes to rest on the second terminal position stop 22, connected to the housing, and in the direction of the arrow 26 until the slide 4*b* comes to rest on the first terminal position stop 21, also attached to the housing.

The spring 8*a* of the spring assembly 8 is connected directly to the adjusting lever 4*a* of the control element 4 via a first pivotable spring connection 31, and via a second pivotable spring connection 32 the spring 8*a* of the spring assembly 8 is connected to the stop piece 12.

In the exemplary embodiment shown in FIG. 1, the speed-changing gear 6 is composed of a first transmission stage 6*a* and a second transmission stage 6*b*. Between the stop piece 12 and the intermediate member 10, in the region of the second transmission stage 6*b*, there is a stop 32*b* operatively associated with the second pivotable spring connection 32, and a stop 10*b*, operatively associated with the intermediate member 10. On the stop piece 12 there is a further stop 32*a*, likewise operatively associated with the second pivotable spring connection 32. With the stop 32*a*, the stop piece 12 can come to rest on the repose stop 20.

As FIG. 1 shows, the movable parts can execute rectilinear motions. However, it should be pointed out that the control element 4 having the adjusting lever 4*a*, and the intermediate member 10 and the stop piece 12 can also be supported rotatably or pivotably. For the sake of better comprehension, it is assumed in the ensuing description that the aforementioned parts are rotatably supported.

The first transmission stage 6*a* changes the speed of the adjusting lever 4*a*, which is connected to the control element 4 in a manner fixed against relative rotation, to an rpm of the intermediate member 10. By way of example, the first transmission stage 6*a* is designed such that the intermediate member 10 rotates by four angular units (for instance, 4°), when the adjusting lever 4*a* rotates by one angular unit (such as 1°). In other words, the change of the rpm of the control element 4 to the intermediate member 10 is one to four (1:4). With the transmission stage 6*a* designed in this way, the torque is converted in such a way that the torque acting upon the intermediate member 10 amounts to one-fourth (¼) of the torque exerted on the control element 4 by the spring assembly 8. This means that the change of the torque from the control element 4 to the intermediate member 10 is four to one (4:1). In other words, the spring assembly 8, via the first pivotable spring connection 31, acts upon the intermediate member 10 in the direction of the arrow 26, and the torque of the spring assembly 8 upon the intermediate member 10 is reduced by the first transmission stage 6*a* by seventy-five percent (75%) to twenty-five percent (25%).

The second transmission stage 6*b* may be designed for instance such that the second transmission stage 6*b* converts a pivoting motion of the stop piece 12 by four angular units (such as 4°). Into a pivoting motion of the intermediate member 10 by seven angular units (such as 7°). As a consequence, the torque of the spring assembly 8 upon the intermediate member 10 is reduced to fifty-seven percent (4/7=0.57, or 57%), via the pivotable spring connection 32, the stop piece 12, the stop 32*b*, and the stop 10*b*. In this exemplary embodiment, via the second pivotable spring connection 32, the spring assembly 8 can act upon the intermediate member 10 with fifty-seven percent (57%), as long as the stop piece 12 with its stop 32*a* has lifted away from the repose stop 20.

If there is no current to the control device 16, then the control device 10 exerts no torque, and the stop 32*a* of the stop piece 12 is then located on the repose stop 20, and the stop 10*b* rests on the stop 32*b*. The control element 4, like the other movable parts, is then in a position of repose. The position of repose is located in an intermediate position between the first terminal position stop 21 and the second terminal position stop 22. The drawing shows the control element 4, as well as the other movable parts, in the position of repose. Beginning at the position of repose, the control device 16 can adjust the control element 4 in the direction of the arrow 24 as far as the terminal position stop 22, or in other words until the adjusting lever 4*a* comes to rest on the second terminal position stop 22, and in the direction of the arrow 26 as far as the terminal position stop 21, or in other words until the slide 4*b*, which may also be a throttle valve, comes to rest on the first terminal position stop 21.

When the control element 4 is located to the left of the position of repose shown in FIG. 1, then the stop piece 12 has lifted away from the repose stop 20, and the spring assembly 8 can act upon the intermediate member 10 in the direction of the arrow 24, via the second pivotable spring connection 32, with the fifty-seven percent (57%) of the original torque as calculated above as an example. At the same time, however, again via the first pivotable spring connection 31, the spring assembly 8 acts upon the intermediate member 10 with twenty-five percent (25%) of the original torque in the direction of the arrow 26, so that what is left over is a torque upon the intermediate member 10 acting in the direction of the arrow 24. With the speed ratios assumed as examples, the resultant torque on the intermediate member 10 in the direction of the arrow 24 is thirty-two percent (57% minus 25%=32%) of the torque generated by the spring assembly 8.

When the control element 4 is located to the right of the position of repose shown in FIG. 1, then the stop piece 12 is resting on the repose stop 20, and the stop 10*b* has lifted from the stop 32*b*. Since in this position of the control element 4 the second pivotable spring connection 32 is supported on the repose stop 20, only the first pivotable spring connection 31 can act with twenty-five percent (25%) on the intermediate member 10 in the direction of the arrow 26.

If there is current to the control device 16 via the electrical line 18, then the electrical control device 16, via the speed-changing gear 14, the intermediate member 10, the transmission stage 6*a*, and via the adjusting lever 4*a*, can adjust the control element 4, beginning at the position of repose shown in FIG. 1, both in the direction of the arrow 26 (to the left) and in the direction of the arrow 24 (to the right), until the control element 4 comes to rest on the first terminal position stop 21 or the second terminal position stop 22.

If the control element 4 is to the left of the position of repose shown in FIG. 1 and if the control device 16 is then turned off, then the spring assembly 8 adjusts the intermediate member 10 in the direction of the arrow 24, until the stop 32*a* rests on the repose stop 20. Via the transmission stage 6*a*, the control element 4 is jointly adjusted until it reaches its position of repose.

Figure 2:
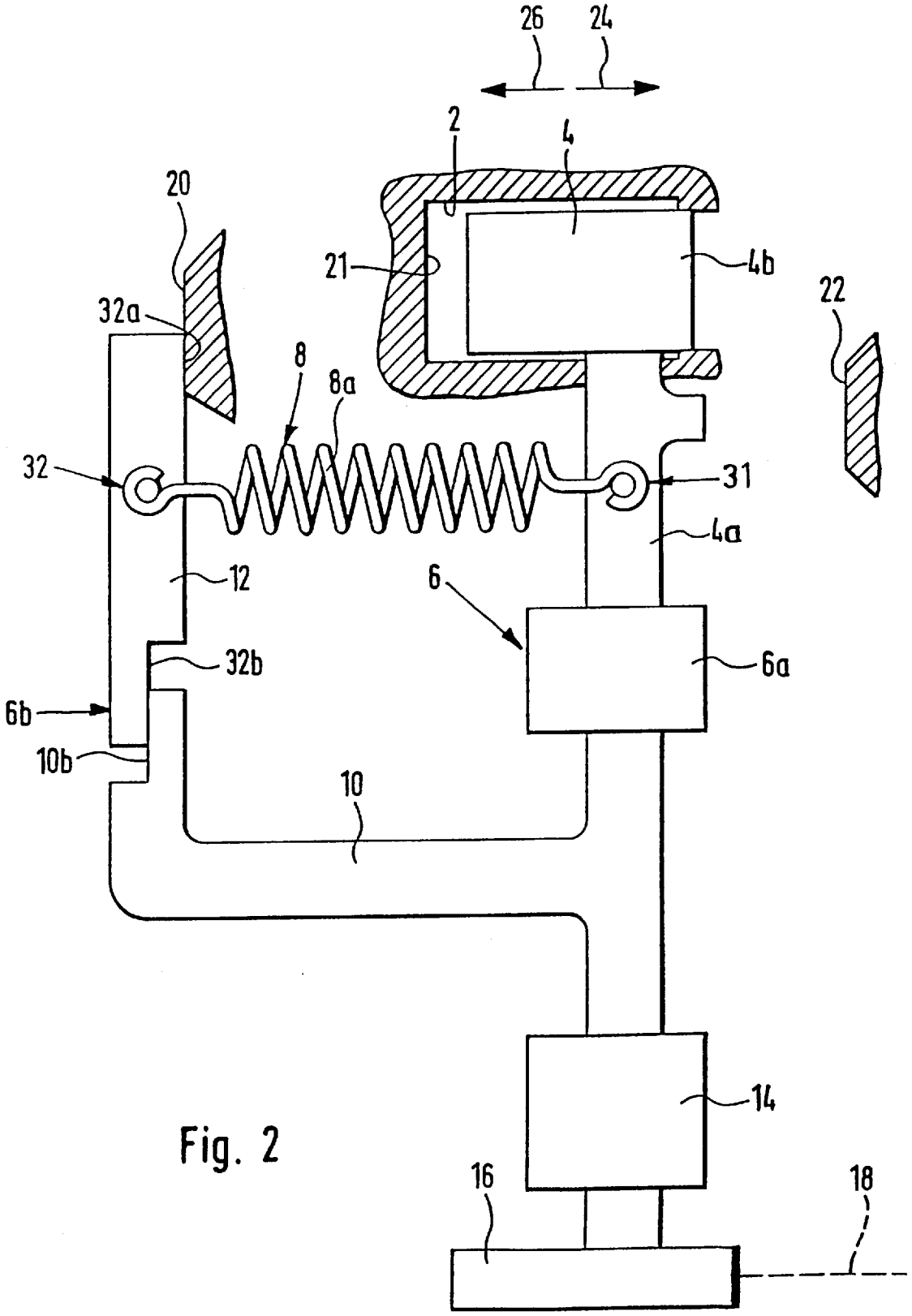

If beginning at the position of repose shown in FIG. 1 the control device 16 has adjusted the control element 4 to the right, and if the control device 16 is then turned off or becomes inoperative because of a defect, then the spring assembly 8 adjusts the control element 4 in the direction of the arrow 26 (to the left), until the stop 10*b* comes to rest on the stop 32*b*, and until the control element 4 is again in the position of repose shown in FIG. 2.

Motions of the intermediate member 10 lead to corresponding motions of the control element 4. The motions of the control element 4 are coupled directly to the motions of the intermediate member 10 via the transmission stage 6*a*. By means of the transmission stage 6*a*, there is a speed change between the motions of the control element 4 and the motions of the intermediate member 10.

FIG. 2 symbolically shows a further exemplary selected possibility for embodying the control device of the invention.

In all the drawing figures, identical elements or those that function identically are provided with the same reference numerals. Unless otherwise mentioned or shown in the drawing, what is described and shown for any one of the drawing figures applies to the other exemplary embodiments as well. Unless otherwise stated in the description, details of the various exemplary embodiments can be combined with one another.

In the exemplary embodiment shown in FIG. 2, a motion of the stop piece 12 is converted into a motion of the same angular magnitude upon the intermediate member 10. In other words, in the exemplary embodiment shown in FIG. 2, a pivoting motion of the stop piece 12 is converted one to one into a pivoting motion of the intermediate member 10 at the second transmission stage 6*b*, and this is why the block, shown in FIG. 1, is not shown for the transmission stage 6*b* in the symbolic view of FIG. 2.

In this exemplary embodiment, the first transmission stage 6*a* for the speed-changing gear 6 is designed for instance such that a pivoting motion of the adjusting lever 4*a* by two angular units (such as 2°) is converted into a rotary motion of the intermediate member 10 by five angular units (such as 5°).

If in this exemplary embodiment the control element 4 is to the left of the position of repose shown in FIG. 2, then because of the speed change of one to one at the second transmission stage 6*b*, the spring assembly 8 acts with undiminished torque in the direction of the arrow 24 upon the intermediate member 10, and via the first pivotable spring connection 31 in the direction of the arrow 27, because of the speed change at the first transmission stage 6*a*, with forty percent (2/5=0.4, or 40%) of the torque generated by the spring assembly 8, so that the intermediate member 10 is moved in the direction of the arrow 24 with sixty percent (100% minus 40%=60%) of the torque generated by the spring assembly, until the stop piece 12 comes to rest on the repose stop 20.

To the right of the position of repose, the intermediate member 10 is urged in the direction of the arrow 26 with 40% of the torque generated by the spring assembly 8.

Figure 3:
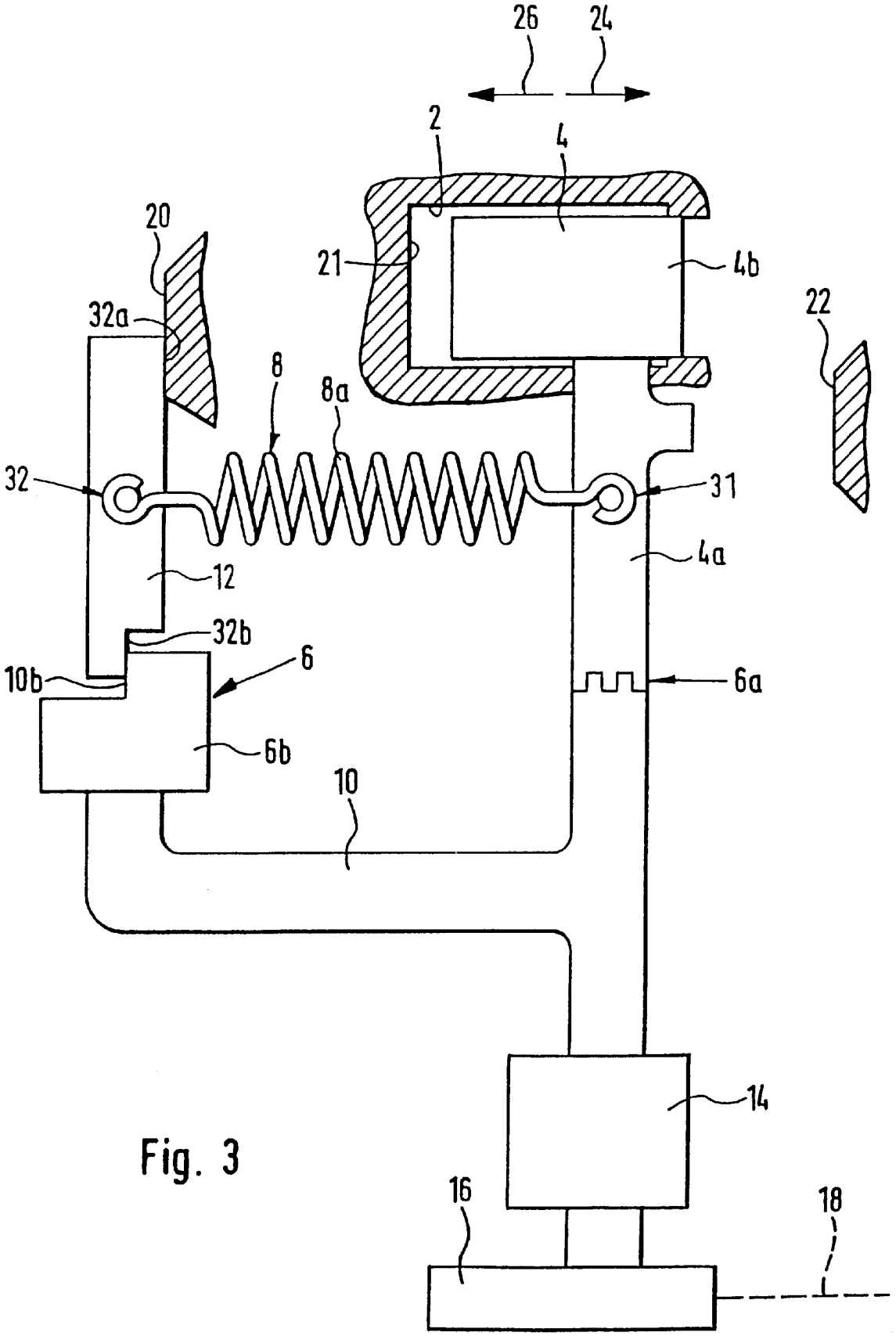

FIG. 3 symbolically shows a further preferably selected exemplary embodiment of the control device of the invention.

Figure 4:
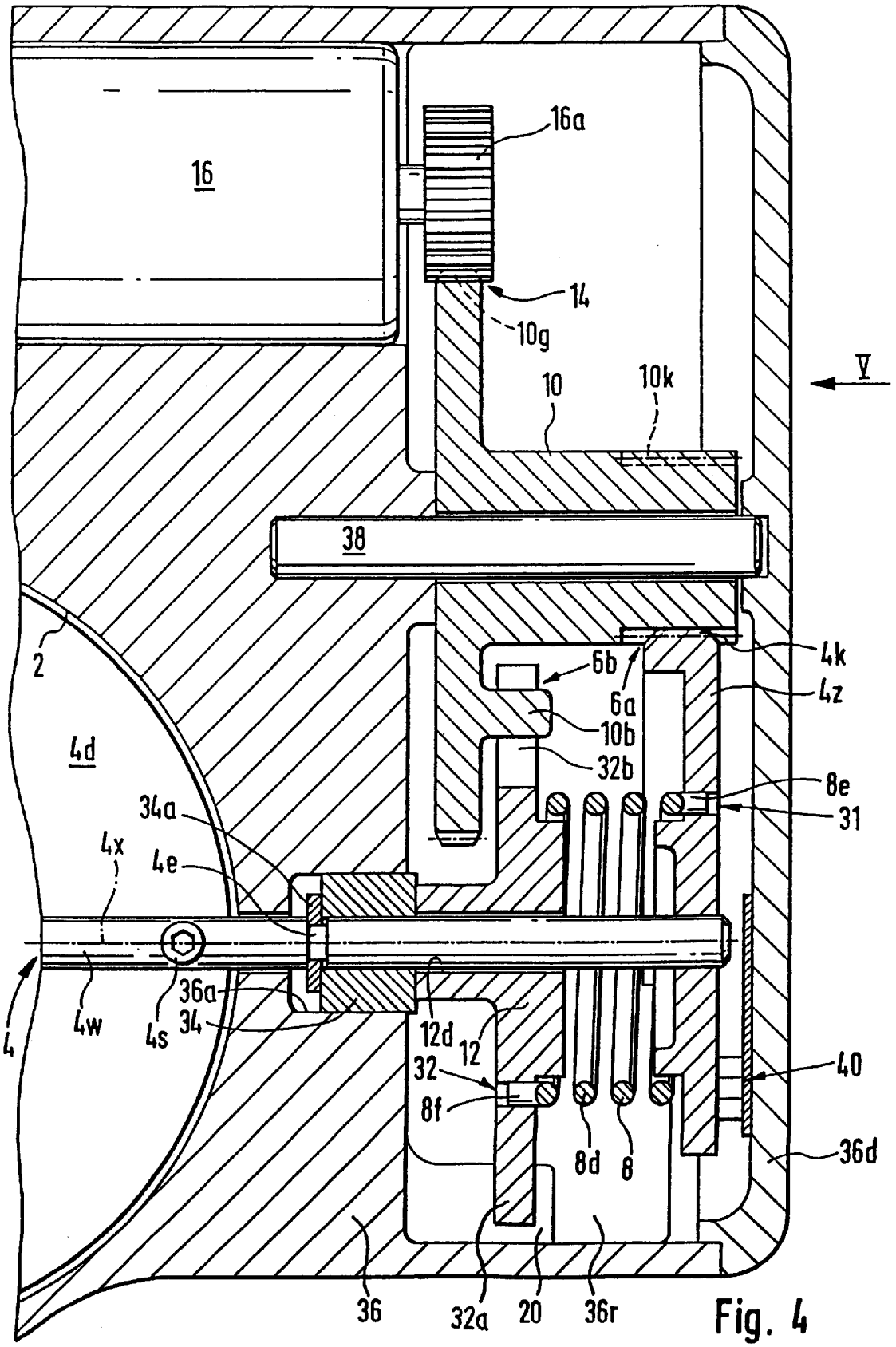
FIGS. 4, 5, 7 and 8 show various details and views of the different exemplary embodiments.

In the exemplary embodiment shown in FIG. 4, a conversion of the rpm between the adjusting lever 4*a* and the intermediate member 10 is dispensed with. The first transmission stage 6*a* is embodied such that a pivoting or rotary motion of the control element 4 is converted into a quantitatively equal-magnitude pivoting or rotary motion, that is, one to one, to the intermediate member 10. In FIG. 3, the rectangular block that symbolizes the first transmission stage 6*a* in FIG. 1 is replaced with right-angled indentations, which is intended to symbolize the fact that the control element 4 and the intermediate member 10 are coupled for motion to one another, and the speed change is one to one.

Figure 5:
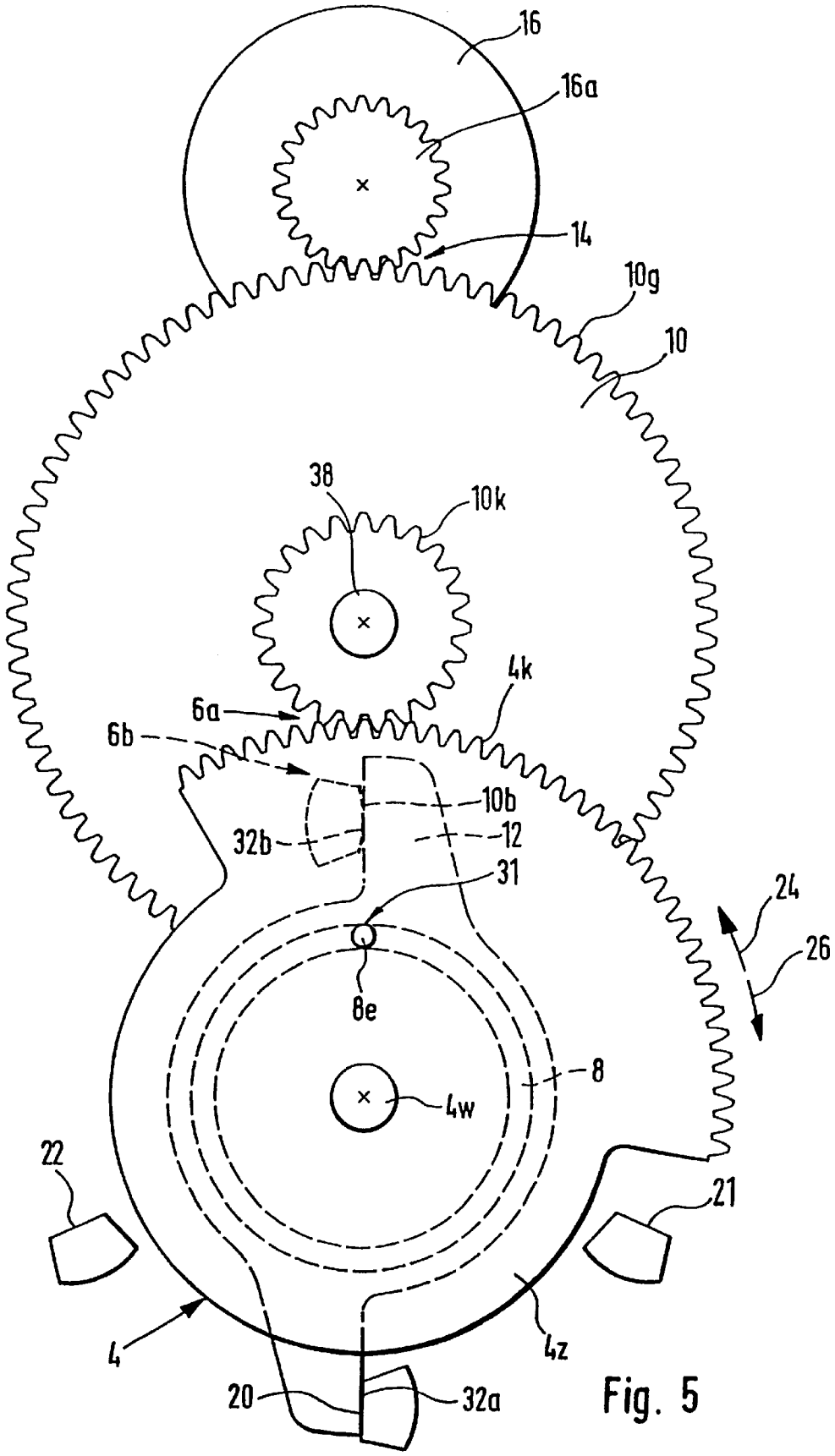

In this exemplary embodiment, the transmission stage 6*b* of the speed-changing gear 6 is designed for instance such that a rotary motion of the stop piece 2 by two angular degrees (such as 2°) produces a rotary motion of the intermediate member 10 by one angular unit (1°). As a result, the spring assembly 8 acts (to the right) upon the intermediate member 10, via the second pivotable spring connection 32, with two hundred percent (200%) of the torque generated by the spring assembly 8. The spring assembly 8 acts to the left upon the intermediate member 10, via the first pivotable spring connection 31, with one-hundred percent torque (100%). As a result, if the control element 4 is to the left of the position of repose shown in FIG. 3, the intermediate member 10 is acted upon by the spring assembly 4 with one hundred percent (200% minus 100%=100%) in the direction of the arrow 24, until the stop 32*a* comes to rest on the repose stop 20. The intermediate member 10 is urged to the right of the position of repose with one hundred percent (100%) of the torque generated by the spring assembly 4 in the direction of the arrow 26. FIGS. 4 and 5 shows examples of details for how the exemplary embodiment, symbolically shown in FIG. 1, may be practically embodied.

In the exemplary embodiment shown in FIG. 4, the control element 4 includes a throttle valve 4*d* and a throttle valve shaft 4*w*. The throttle valve 4*d* is firmly connected to the throttle valve shaft 4*w* via a fastening screw 4*s*. A toothed quadrant 4*z* is firmly connected to the throttle valve shaft 4*w*. The throttle valve 4*d*, the throttle valve shaft 4*w*, and the toothed quadrant 4*z* have the same function as the adjusting lever 4*a* and the slide 4*b* secured to the adjusting lever 4*a* shown in FIG. 1.

FIG. 4 shows a housing 36. The housing 36 preferably takes the form of a throttle valve stub and acts as a throttle valve stub. A transmission chamber 36*r* is formed in the housing 36. The transmission chamber 36 is covered with the aid of a cap 36*d*. The cap 36*d* is part of the housing 36.

The throttle valve shaft 4*w* is supported pivotably or rotatably in the housing 36 via a bearing 34. The throttle valve shaft 4*w* has a pivot axis 4*x*. There is a turned groove 36*a* in the housing 36 for receiving the bearing 34. The bearing 34 has an outer diameter that is adapted to the turned groove 36*a* in such a way that after being press-fitted into the turned groove 36*a*, the bearing 34 is rigidly connected to the housing 30. As a result, the bearing 34 is capable of retaining the throttle valve shaft 4*w* in both the radial and the axial direction. By way of example, the bearing 34 is a slide bearing.

As FIG. 4 shows, the intermediate member 10 takes the form of a gear wheel, with a first set of teeth 10*g* of large radius and a second set of teeth 10*k* with a small radius. The intermediate member 10 is rotatably supported on an axle 38 that is firmly joined to the housing 36.

The toothed quadrant 4*z* firmly joined to the throttle valve shaft 4*w* has an outer set of teeth 4*k*. To adjust the throttle valve 4*d*, 90° is typically sufficient, so that for the outer teeth 4*k*, an angular arc of approximately 110° is typically sufficient.

The stop piece 12 has a through bore 12*d*. With the aid of the through bore 12*d*, the stop piece 12 is freely rotatably supported on the throttle valve shaft 4*w*. The spring assembly 8 includes a helically coiled torsion spring 8*d*. The torsion spring 8*d* of the spring assembly has a first spring end 8*e* that engages the toothed quadrant 4*z* and a second spring end 8*f* that engages the stop piece 12. At the point where the spring end 8*e* engages the toothed quadrant 4*z*, the first pivotable spring connection 31 is formed, and the second pivotable spring connection 32 is located where the second spring end 8*f* engages the stop piece 12. Via the spring ends 8*e* and 8*f*, the spring assembly 8 can exert a torque both upon the toothed segment 4*z* of the control element 4 and upon the stop piece 12.

The spring assembly 8 may instead include only a single torsion spring 8*d*, or two or three or more individual springs. These multiple springs may be dimensioned such that if one of the springs should fail, the rest of the springs are strong enough to restore the control element 4 to its position of repose.

Located in the transmission chamber 36*r*, among other elements, are the intermediate member 10, the stop piece 12, the spring assembly 8, the toothed quadrant 4*z*, and an angle sensor 40. One part of the angle sensor 40 is firmly connected to the cap 36, and one part of the angle sensor 40 is located on the toothed quadrant 4*z*. The angle sensor 40 can sense the rotary position of the throttle valve 4*d* at any given time.

The spring assembly 8 exerts a torque about the pivot axis 4*x* via the pivotable spring connection 31 and via the toothed quadrant 4*z* upon the control element 4, and a conversely oriented torque on the stop piece 12 via the second pivotable spring connection 32. The length of the torsion spring 8*d* is such that the spring assembly 8 in addition to this torque generates a force axially to the pivot axis 4*x*. This force seeks to force the toothed quadrant 4*z* and the stop piece 12 axially apart. As a result, the stop piece 12 is pressed axially (to the left in FIG. 4) against the bearing 34 that is firmly press-fitted into the housing 36. At the same time, via the toothed quadrant 4*z*, the spring assembly 8 forces the throttle valve shaft 4*w* to the right. To intercept this axial force of the spring assembly 8 upon the throttle valve shaft 4*w*, a notch 4*e* with a securing shim 34*a* placed in it is provided in the throttle valve shaft 4*w*. The securing shim 34*a* is supported on one side on the edge of the notch 4*e* and on the other is pressed axially (to the right in FIG. 4) against the bearing 34 by the spring assembly 8. As already noted, the bearing 34 is firmly connected to the housing 36 by a press fit. The throttle valve 4*d* is exactly positioned in the axial direction by the axial initial tension on the throttle valve shaft 4*w* that originates in the spring assembly 8.

As the exemplary embodiment shows, the spring assembly 8 can be used both to generate a torque and to fix the throttle valve 4*d* axially relative to the gas conduit 2.

FIG. 5 shows a view in the direction of an arrow marked V in FIG. 4. In FIG. 5, the cap 36*d* and the housing 36 are not shown, for the sake of better comprehension. Of the housing, FIG. 5 shows only the repose stop 20 formed onto the housing 36 and the terminal position stops 21 and 22, also formed onto the housing 36.

As FIG. 5 shows, the adjusting motion of the control element 4 in the direction of the arrow 24 is limited when a stop, provided on the toothed quadrant 4*z*, comes to rest on the second terminal position stop 22 connected to the housing. The rotary motion of the control element 4 in the direction of the arrow 26 is limited by a stop provided on the toothed quadrant 4*z*, and this stop can come to rest on the first terminal position stop 21 connected to the housing. However, it is also possible to limit the pivoting motion of the control element 4 in the direction of the arrow 26 by causing the throttle valve 4*d* (FIG. 4) to strike the gas conduit 2. This corresponds to the situation in the exemplary embodiment shown in FIG. 1, in which the slide 4*b*, corresponding to the throttle valve 4*d*, upon motion in the direction of the arrow 26 strikes the gas conduit 2, on which the first terminal position stop 21 is located.

If the toothed quadrant 4*z*, firmly connected to the throttle valve 4*d*, is rotated in the direction of the arrow 26 (FIG. 5), then the gas conduit 2 (FIG. 4) is closed, and the output of the driving machine is reduced. Rotation of the toothed quadrant 4*z* in the direction of the arrow 24 opens the gas conduit 2 and increases the output of the driving machine.

The electrical control device 16, via the intermediate member 10, can adjust the toothed quadrant 4*z* of the control element 4 in the direction of the arrow 26, until the toothed quadrant 4*z* (FIG. 5), or the slide 4*b* (FIG. 1), or the throttle valve 4*d* comes to rest on the first terminal position stop 21. In the opposite direction (in the direction of the arrow 24), the control device 16 can rotate the control element 4 until the toothed quadrant 4*z* comes to rest on the second terminal position stop 22 (FIG. 5). The control device is preferably designed such that the driving machine operates at minimal output (when the control element 4 is located on the first terminal position stop), and at maximal output if the control element 4 is located at the second terminal position stop 22.

The spring assembly 8 acts via the first pivotable spring connection 31 and via the outer teeth 4*k* upon the intermediate member 10, and along with this the spring assembly 8 acts upon the intermediate member 10 via the second pivotable spring connection 32, via the stop piece 12 via the stop 32*b*. Because the radius of the outer teeth 4*k* is greater than the radius of contact between the two stops 10*b* and 32*b*, the spring assembly 8 exerts a resultant torque upon the intermediate member 10 as explained in conjunction with FIGS. 1–3. Since the intermediate member 10 is in operative engagement with the control element 4 via the teeth 10*k*, 4*k*, there is a resultant torque upon the control element 4 in the direction of the arrow 24, when the control element 4 is located between the position of repose shown and the first terminal position stop 21, and a torque upon the control element 4 in the direction of the arrow 26, when the control element 4 is located between the position of repose shown and the second terminal position stop 22.

In order to obtain the speed-changing gear 6 with the transmission stages 6*a*, 6*b* on the order of magnitude described in conjunction with FIG. 4, the radius of the outer teeth 4*k* (FIG. 5) is made four times as great as the radius of the teeth 10*k*, which results in an rpm change from one to 4 (1:4), or a torque conversion from four to one (4:1). And the radius of the stop 32*b* in proportion to the radius of the stop 10*b* is made to be the ratio of seven to four (7:4), which results in an rpm change from the second pivotable spring connection 32 to the intermediate member 10 from four to seven (4:7) or a torque change from seven to four (7:4).

In order to obtain the speed-changing gear 6 with the transmission stage 6*a* described in conjunction with FIG. 2, the radius of the stop 10*b* is made equal to the radius of the stop 32*b*, and the radius of the outer teeth 4*k* is made two and a half (2.5) times as great as the radius of the teeth 10*k*.

To obtain the ratio described in conjunction with FIG. 3 for the speed-changing gear 6 with the transmission stage 6*b*, the radius of the outer teeth 4*k* is selected to be equal to the radius of the teeth 10*k*, and the radius of the stop 10*b* is made twice as great as the radius of the stop 32*b*.

Turning once again to FIG. 1, it will be noted that the intended action of the spring assembly 8 is obtained even if via the first transmission stage 6*a* the rpm of the first pivotable spring connection 31 to the intermediate member 10 is increased somewhat, and at the same time if via the second transmission stage 6*b* the rpm of the second pivotable spring connection 32 to the intermediate member 10 is reduced somewhat.

As FIGS. 4 and 5 show, the electrical control device 16 is operatively connected to the intermediate member 10, via a gear wheel 16*a* and the teeth 10*g*, and is operatively connected to the control element 4 via the teeth 10*k* and the outer teeth 4*k*. In order for the control device 16 to be as small as possible in size, an electric motor, in particular a dc motor, with a high rpm is used for the control device 16. As the drawing shows, the rpm of the control device is transmitted to the throttle valve shaft 4*w* via two stages. The speed-changing gear 14 is the first stage, and the transmission stage 6*a* of the speed-changing gear 6 is the second stage. Since the various transmission stages of the control device embodied according to the invention can essentially also be jointly used for reducing the high rpm of the control device 16 to a low rpm of the throttle valve shaft 4*w*, only a few parts in all are needed in the control device. There is the major advantage that the spring assembly 8, which can preferably comprise merely a single spring, is capable of adjusting the control element in both rotary directions, that is, the directions of the two arrows 24 and 26, to the position of repose. No additional spring is needed.

Figure 6:
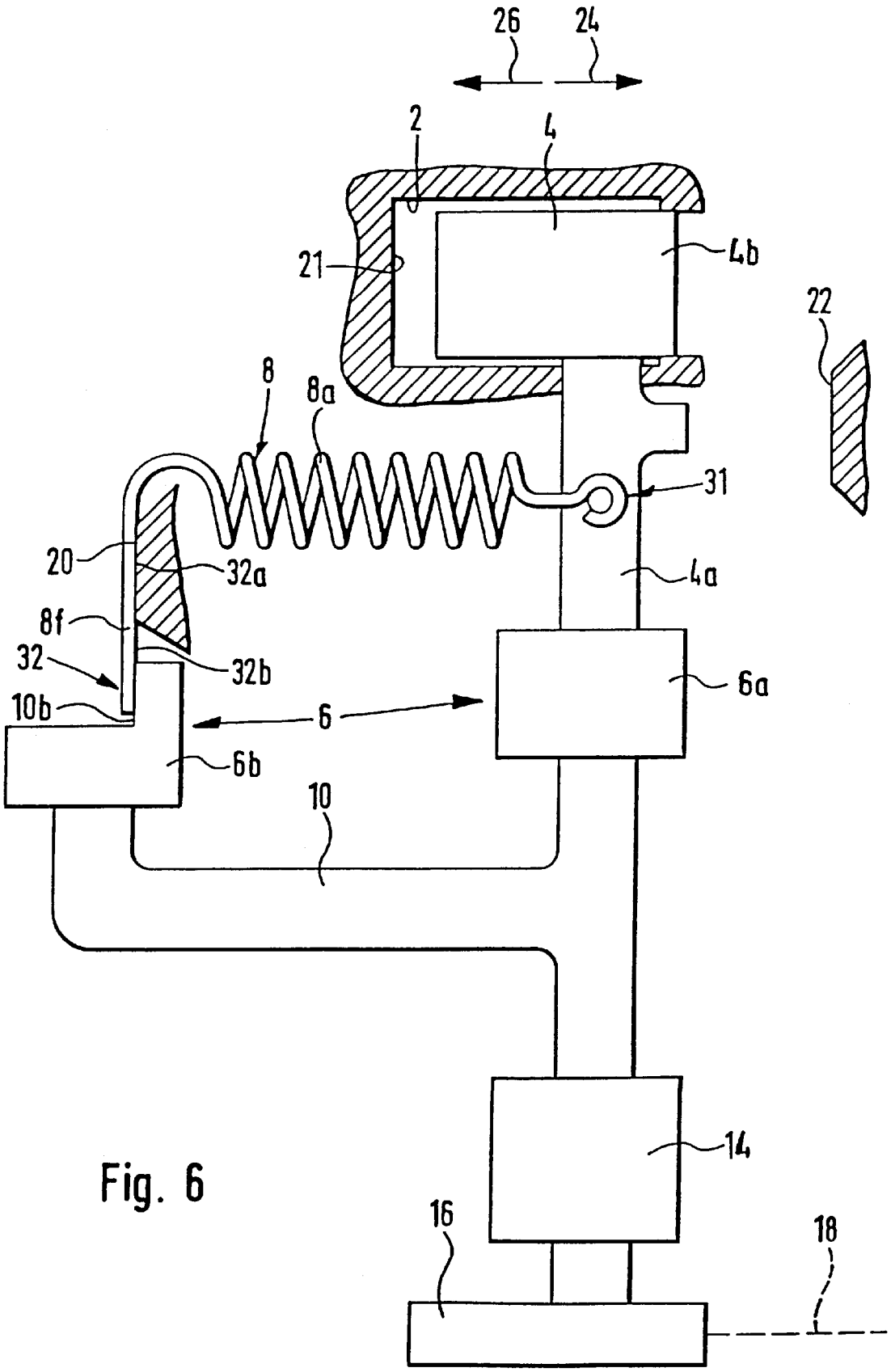
Figure 7:
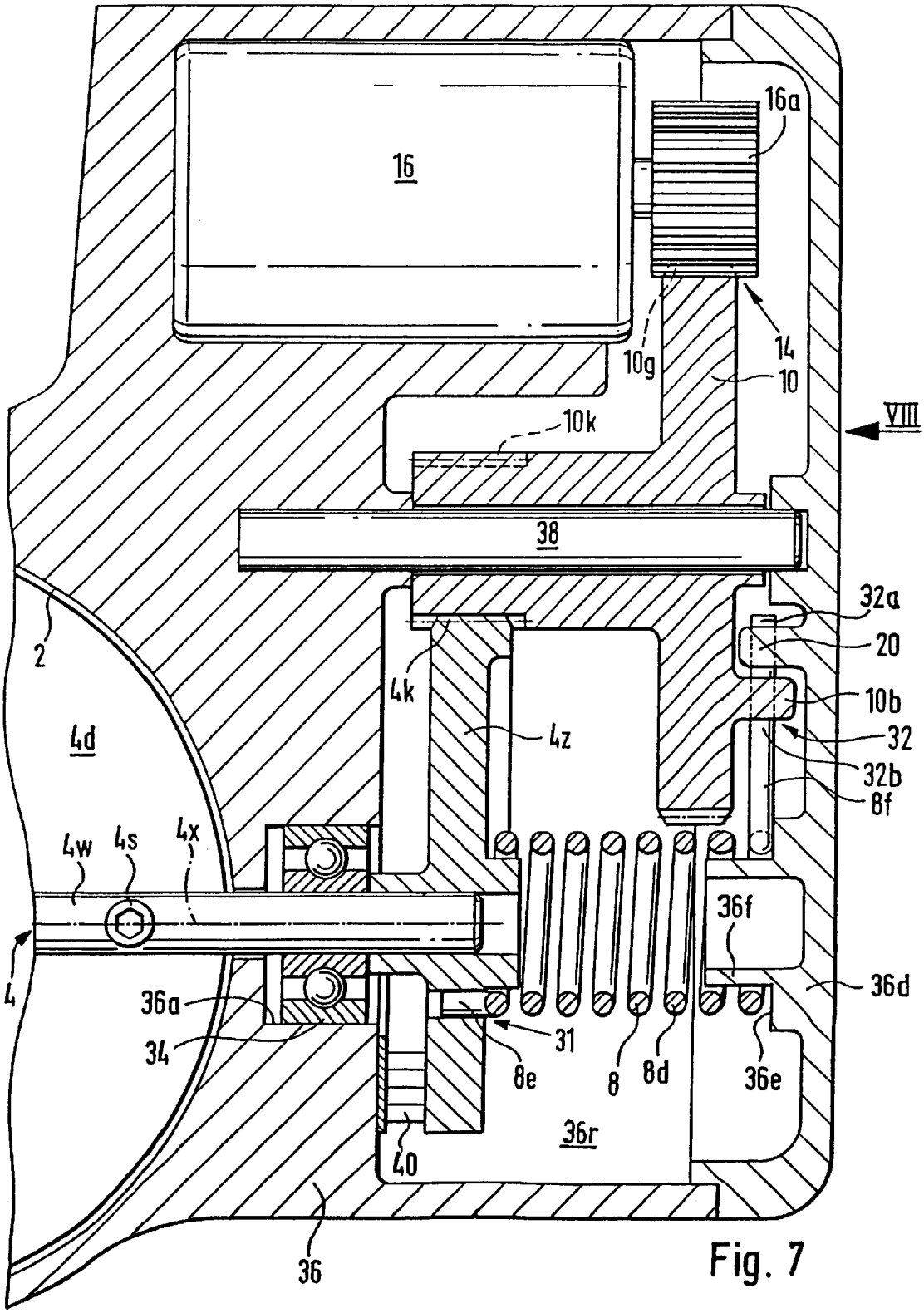
Figure 8:
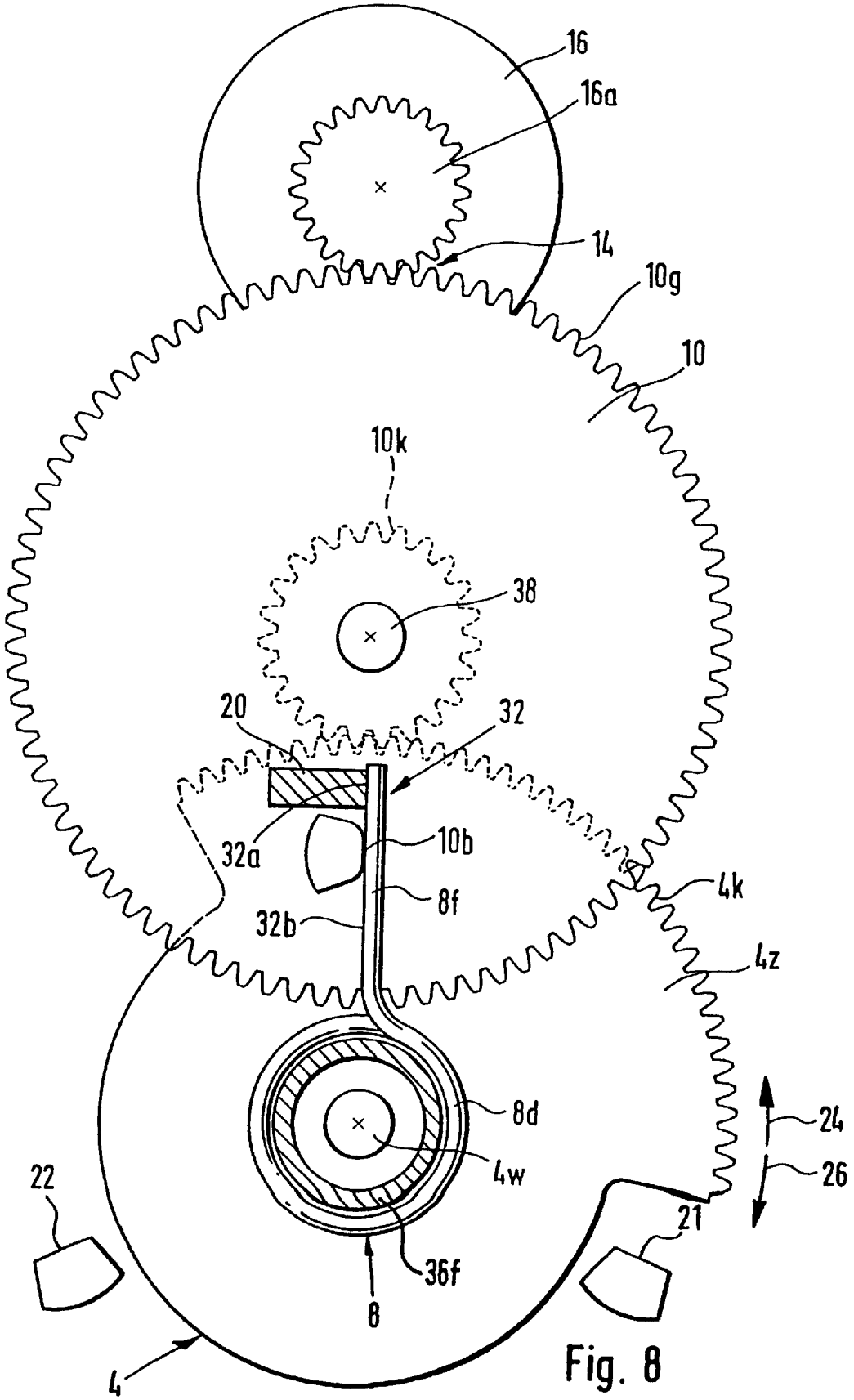

FIGS. 6, 7 and 8 will now show examples of possible ways to dispense with the stop piece 12 shown in FIGS. 1–5.

FIG. 6 symbolically shows a further exemplary, especially advantageous selected possible way to embody the control device of the invention.

In the exemplary embodiment shown in FIG. 6, the spring end 8*f* of the spring assembly 8, in the region of the second pivotable spring connection 32, is embodied such that when the control element 4 is in the position of repose shown in the drawing, the spring end 8*f* can rest both on the repose stop 20 and on the stop 10*b* associated with the intermediate member 10.

If the control device 16 adjusts the control element 4 out of the position of repose shown in the direction of the terminal position stop 22, then the stop 10*b* lifts from the stop 32*b* provided on the spring end 8*f*, and the spring assembly 8 acts upon the control element 4 in the direction of the first terminal position stop (arrow 26).

If the control device 16 adjusts the control element 4 out of the position of repose shown in the drawing in the direction of the first terminal position stop 21 (arrow 26), then the pivotable spring connection 32 is carried along by the intermediate member, via the stops 10*b*, 32*b*, in the direction of the arrow 26, and the stop 32*a* on the spring end 8*f* of the spring assembly 8 lifts away from the repose stop 20. As a result, by means of the spring assembly 8, a force or resultant torque acts upon the intermediate member 10 in the direction of the arrow 24. This resultant force or torque is transmitted from the intermediate member 10 to the control element 4. Accordingly, the spring assembly 8 acts upon the control element 4 in the direction of the arrow 24, until the control element 4 reaches the position of repose shown in the drawing.

In FIG. 6, the further exemplary embodiment is shown more schematically, for the sake of better comprehension and greater clarity. FIGS. 7 and 8 again show this further exemplary embodiment in order to make the practical feasability clear.

FIG. 7 shows a cross section through a further selected, especially advantageous exemplary embodiment.

In an extension of the throttle valve shaft 4, a shoulder 36*e* and a spring guide 36*f* are provided on the cap 36*d*. The spring assembly 8 can be supported in the axial direction on the shoulder 36*e*, so that via the toothed quadrant 4*z* the spring assembly 8 can exert a force upon the throttle valve shaft 43 in the longitudinal direction of the pivot axis 4*x*. The spring assembly 8 tenses the toothed quadrant 4*z*, which is firmly connected to the throttle valve 4*d* via the throttle valve shaft 4*w*, on its face end against the bearing 34. In the exemplary embodiment shown in FIG. 7, the bearing 34 is a roller bearing, which can transmit forces both in the radial direction and in the axial direction. The bearing 34 has an outer ring, which is firmly fixed relative to the housing 36. An inner ring of the bearing 34 guides the throttle valve shaft 4*w* in the radial direction. The fixation of the outer ring with respect to the housing 36 can be done by a suitable press fit. Because the spring assembly 8 resiliently prestresses the toothed quadrant 4*z* against the bearing 34, an accurate axial guidance of the throttle valve 4*d* relative to the gas conduit 2 is obtained.

As FIG. 7 shows, the bent spring end 8*e* of the spring assembly 8 is suspended in a bore provided in the toothed quadrant 4*z*. The first pivotable spring connection 31 is formed at this suspension point.

FIG. 8 shows an end-on view of the control device. The viewing direction for FIG. 8 is indicated by an arrow VIII in FIG. 7. In FIG. 8, for better clarity, the housing 36 and cap 36*d* have essentially been omitted. All that can be seen of the housing 36 are a section through the spring guide 36*f* and a section through the repose stop 20, which is located on the housing 36, specifically on the cap 36*d*, as well as the terminal position stops 21 and 22 connected to the housing. Again in this exemplary embodiment, the terminal position stop 21 can be formed in that the toothed quadrant 4*z* can come to rest on the housing 36, or in that the throttle valve 4*d* of the control element 4 strikes the wall of the gas conduit 2.

As can be seen from FIGS. 7 and 8, the torsion spring 8*d* of the spring assembly 8 is wound helically. The torsion spring 8*d* can exert a torque on the control element 4 via the pivotable spring connection 31 and on the intermediate member 10 via the pivotable spring connection 32. In the region of the pivotable spring connection 32, the wire of the spring assembly 8 is bent radially outward. The spring end 8*f* in the region of the pivotable spring connection 32 thus forms a lever arm, which rests on the stop 10*b* of the intermediate member 10 and/or on the repose stop 20 connected to the housing, depending on the position of the control element 4. The situation in which the spring end 8*f* of the spring assembly 8 in the region of the second pivotable spring connection 32 rests on the stop 10*b* or the repose stop 20 has already been described in detail in conjunction with FIG. 6.

The control device is used to control the output of a driving machine, in particular a driving machine of a vehicle. The position of the control element 4 determines the output of the driving machine. The control device is intended in particular for Otto engines, and the control device is especially practical whenever the control element 4 is a throttle valve rotatably supported on a throttle valve shaft. The control device 16 is used to adjust the throttle valve 4*d* of the control element 4 between the first terminal position, determined by the first terminal position stop 21, and the second terminal position, determined by the second terminal position stop 22. If the control device 16 fails, the spring assembly 8 moves the throttle valve 4*d* into the position of repose, which is determined by the repose stop 20. The repose stop 20 is located between the first terminal position and the second terminal position. The spring assembly 8 acts on the control element via the first pivotable spring connection 31 and via this control element on the intermediate member in the direction of the first terminal position, which is determined by the first terminal position stop 21, and via the second pivotable spring connection 32 on the intermediate member 10 in the direction of the second terminal position, which is determined by the second terminal position stop 22, until in each case the position of repose determined by the repose stop 20 is reached. Because the control element 4 is operatively connected to the intermediate member 10, or in other words because the control element 4 is coupled in terms of motion to the intermediate member 10, then in the event that the control device 16 fails the control element 4 together with the intermediate member 10 reaches the intended position of repose. At least one speed-changing gear 6 is provided between the spring assembly 8 and the intermediate member 10. With the speed-changing gear 6 it is attained that between the first terminal position (first terminal position stop 21) and the position of repose (repose stop 20), the action (force or torque) of the spring assembly 8 on the intermediate member 10 is greater in the direction of the second terminal position (second terminal position stop 22) than the action of the spring assembly 8 in the direction of the first terminal position (first terminal position stop 21). Forces which, because the corresponding parts are rotatably supported, as shown in FIGS. 4, 5, 7 and 8, produce corresponding torques are the effect of the spring assembly 8. The speed-changing gear 6 can have various transmission stages, as has already been explained at length in particular in conjunction with FIGS. 1–3 for the transmission stages 6*a* and 6*b*.

The control device is preferably embodied such that if the control element 4 is in the first terminal position determined by the first terminal position stop 21, the driving machine operates at minimum output or is completely turned off or produces no output. If the control element 4 is in the second terminal position, determined by the second terminal position stop 22, then the driving machine preferably functions at maximum output.

The position of repose determined by the repose stop 20 is preferably defined such that in the position of repose, the driving machine produces enough output to enable emergency operation of the motor vehicle.

It is especially expedient to design the transmission stages 6*a* and 6*b* of the speed-changing gear 6 in such a way that the first transmission stage 6*a* increases the rpm from the first pivotable spring connection 31 to the intermediate member 10 by a first speed change amount, and the second transmission stage 6*b* increases the rpm from the second pivotable spring connection 32 to the intermediate member 10 by a second speed-change amount, the first such amount being greater than the second such amount. If one considers the forces or torques, then it is especially expedient to design the transmission stages 6*a* and 6*b* of the speed-changing gear 6 in such a way that the first transmission stage 6*a* reduces the force or torque from the first pivotable spring connection 31 to the intermediate member 10 by a first speed-change amount, and the second transmission stage 6*b* reduces the force or torque from the second pivotable spring connection 32 to the intermediate member 10 by a second speed-change amount, the first such amount being greater than the second. In other words, at the first transmission stage 6*a*, the force or torque of the spring assembly 8 from the control element 4 to the intermediate member 10 is reduced more markedly than at the second transmission stage 6*b* from the second pivotable spring connection 32 to the intermediate member 10. In the exemplary embodiments shown in FIGS. 4, 5, 7 and 8, this especially expedient allocation of the speed-changing gear 6 is specified by the corresponding radii selected.

Since via the first transmission stage 6*a* the torque is transmitted from the control device 16 to the throttle valve 6*d*, a gear-wheel speed change is especially expedient for the first transmission stage 6*a*. Since the second transmission stage 6*b* also serves in particular to define the position of repose exactly, no complicated gear-wheel speed change is needed in the region of the second transmission stage 6*b*; instead, as shown in FIGS. 4, 5, 7 and 8, the stops 32*b* and 10*b* suffice; they can be brought into mutual engagement and serve as leverage. Between the first terminal position, determined by the first terminal position stop 21, and the position of repose, only a relatively small angle, such as 15°, is traversed; once again, this enables the easily produced leverage with the two stops 10*b*, 32*b*.

The repose stop 20 may be embodied adjustably, for instance by using a screw with the repose stop 20. Via this screw, this position of repose of the throttle valve 4*d* that belongs to the control element 4 can be adjusted. However, the position of repose of the throttle valve 4*d* can also be adjusted by rotating the toothed quadrant 4*z* appropriately relative to the throttle valve shaft when the control device is being installed, until the throttle valve 4*d* reaches the desired position in which the stop 32*a* rests on the repose stop 20. Only after that is the toothed quadrant 4*z* fixed on the throttle valve shaft 4*w*.

As the exemplary embodiments shown illustrate, the spring 8*a* of the spring assembly 8 (FIGS. 1, 2, 3, 6), or the torsion spring 8*d* of the spring assembly 8 (FIGS. 4, 5, 7, 8), is pivotably connected directly to the control element 4. In other words, via the first pivotable spring connection 31, the spring assembly 8 acts directly and continuously on the control element 4. In particular, nothing that would have to couple the spring assembly 8 to the control element 4, or to uncouple it from it, is needed.

The foregoing relates to preferred exemplary embodiments of the invention, it being understood that other variants and embodiments thereof are possible within the spirit and scope of the invention, the latter being defined by the appended claims.

I claim:

1. A control device for controlling an output of a driving machine of a vehicle, comprising a control element (4, 4*b*, 4*d*) that determines an output of the driving machine, a control device (16) for adjusting the control element (4, 4*b*, 4*d*) between a first terminal position (21) and a second terminal position (22), a spring assembly (8) that upon failure of the control device (16) adjusts the control element (4, 4*b*, 4*d*) to the position of repose (20), the position of repose (20) being located between the first terminal position (21) and the second terminal position (22), an intermediate member (10) which is operatively connected to the control element (4, 4*b*, 4*d*) is provided, wherein the spring assembly (8) via a first spring connection (31) acts upon the intermediate member (10) in a direction of the first terminal position (21) and via a second spring connection (32) the spring assembly operates in a direction of the second terminal position (22) until reaching the position of repose (20), and between the spring assembly (8) and the intermediate member (10) at least one speed-changing gear (6, 6*a*, 6*b*) is provided, by which a first action of the spring assembly (8) on the intermediate member (10) between the first terminal position (21) and the position of repose (20) in the direction of the second terminal position (22) is greater than the second action of the spring assembly (8) in the direction of the first terminal position (21).

2. A control device in accordance with claim 1, in which when the control element (4, 4*b*, 4*d*) is in the first terminal position (21), the driving machine operates at minimum output, and when the control element (4, 4*b*, 4*d*) is in the second terminal position (22), the driving machine operates at maximum output.

3. A control device in accordance with claim 1, in which the control element (4, 4*b*, 4*d*) and the intermediate member (10) are rotatably supported, and the first action of the spring assembly is a first torque and the second action of the spring assembly (8) is a second torque.

4. A control device in accordance with claim 2, in which the control element (4, 4*b*, 4*d*) and the intermediate member (10) are rotatably supported, and the first action of the spring assembly is a first torque and the second action of the spring assembly (8) is a second torque.

5. A control device in accordance with claim 1, in which the speed-changing gear (6, 6*a*, 6*b*) is composed of a first transmission stage (6*a*) between the first spring connection (31) and the intermediate member (10) and a second transmission stage (6*b*) between the second spring connection (32) and the intermediate member (10).

6. A control device in accordance with claim 2, in which the speed-changing gear (6, 6*a*, 6*b*) is composed of a first transmission stage (6*a*) between the first spring connection (31) and the intermediate member (10) and a second transmission stage (6*b*) between the second spring connection (32) and the intermediate member (10).

7. A control device in accordance with claim 5, in which the first transmission stage (6*a*) from the first spring connection (31) to the intermediate member (10) raises the rpm by a first speed change amount, and the second transmission stage (6*b*) from the second spring connection (32) to the intermediate member (10) raises the rpm by a second speed change amount, the first such amount being greater than the second such amount.

8. A control device in accordance with claim 5, in which the first transmission stage (6*a*) from the first spring connection (31) to the intermediate member (10) raises the rpm by a first speed change amount, and the second transmission stage (6*b*) from the second spring connection (32) to the intermediate member (10) raises the rpm by a second speed change amount, the first such amount being greater than the second such amount.

9. A control device in accordance with claim 5, in which the first transmission stage (6*a*) is a gear-wheel type speed changer.

10. A control device in accordance with claim 5, in which the second transmission stage (6*b*) is a lever-type speed changer.

11. A control device in accordance with claim 1, in which the second spring connection (32) acts upon the intermediate member (10) via a stop piece (12) until the stop piece (12) in the position of repose (20) comes to rest on a repose stop (20).

12. A control device in accordance with claim 1, in which the second spring connection (32) acts upon the intermediate member (10) until the second spring connection (32) in the position of repose (20) comes to rest on a repose stop (20).

13. A control device in accordance with claim 11, in which the repose stop (20) is adjustable.

14. A control device in accordance with claim 11, in which the repose stop (20) determines an emergency operation point of the driving machine.

15. A control device in accordance with claim 1, in which the control device (16) is connected to the control element (4, 4*b*, 4*d*) via the intermediate member (10).

16. A control device in accordance with claim 15, in which a speed-changing gear (14) that reduces an rpm of the control device (16) is provided between the control device (16) and the intermediate member (10).

17. A control device in accordance with claim 1, in which the control element (4, 4*b*, 4*d*) is a throttle valve (4*d*), secured to a throttle valve shaft (4*w*) and supported rotatably about a pivot axis (4*x*) in a housing (36), and the spring assembly (8) serves to axially tense the throttle valve shaft (4*w*) against an axial stop (34, 34*a*) associated with the housing (36).

18. A control device in accordance with claim 17, characterized in that the spring assembly (8), for the axial tensing of the throttle valve shaft (4*w*) against the axial stop (34, 34*a*), is braced in the opposite direction on the housing (36, 36*d*) (FIG. 7).

19. A control device in accordance with claims 11 in which the spring assembly (8) is braced on the housing (36) via the stop piece (12) (FIG. 4).

20. A control device in accordance with claim 1, in which the spring assembly (8) acts upon the control element (4) without interruption.

* * * * *